United States Patent [19]

Kaze

[11] 4,416,204

[45] Nov. 22, 1983

[54] AUTOMATIC PIPING MACHINE

[75] Inventor: Akira Kaze, Sakai, Japan

[73] Assignee: Eagle Industry Co., Ltd., Osaka, Japan

[21] Appl. No.: 194,949

[22] Filed: Oct. 8, 1980

[30] Foreign Application Priority Data

Dec. 19, 1979 [JP] Japan ..... 54-165850

[51] Int. Cl.[3] ..... D05B 3/00

[52] U.S. Cl. ..... 112/68

[58] Field of Search ..... 112/65, 68, 130, 129

[56] References Cited

U.S. PATENT DOCUMENTS 3,653,345 4/1972 Bianchi ..... 112/65
3,745,946 7/1973 Bianchi ..... 112/65
3,814,037 6/1974 Nicolay ..... 112/68
4,096,810 6/1978 Bianchi ..... 112/65

*Primary Examiner*—H. Hampton Hunter
*Attorney, Agent, or Firm*—Larson and Taylor

[57] ABSTRACT

The present invention relates to an automatic piping machine characterizing that after giving a cut to the opening of pockets by a center knife on suit materials simultaneously with the stitching of both sides thereof by two needles a chevron-shaped cut is given to both ends of aforesaid cut, that by mechanical means said needles and the operation limit switch of center knife and the stopper of corner knife are set to respectively travel simultaneously to opposite direction for an equal distance in order to automatically regulate the working positions of said needles, center knife and corner knife in line with the change in pocket sizes.

10 Claims, 5 Drawing Figures

AUTOMATIC PIPING MACHINE

The present invention relates to an automatic piping machine characterizing that in case a pocket is stitched on suit materials a cut is given to the opening of pocket and, at the same time, along both sides of said cut, pipings or flaps are stitched automatically and, more particularly, in accordance with the change in pocket sizes of said pipings and etc. the working positions of needles, center and corner knives are made to automatically worked out.

Figure 5:
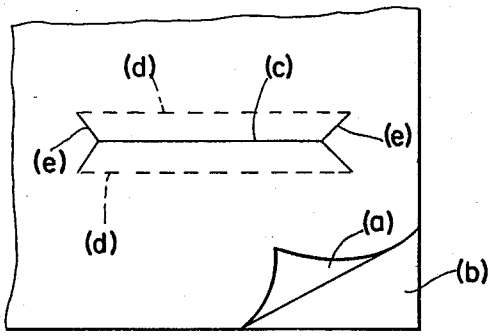

Generally in case pipings are formed on the opening of pocket by the use of automatic piping machine, as a preliminary step, as shown in FIG. 5, the right-side cloth (a) is piled on the lining cloth (b), then at least a cut (c) is given to the opening of pocket by the center knife, then by two needles operating at the same time on both sides of said cut, stitching (d) is done and then further cuts (e) (e) are given so that both ends of said cut (c) come to the chevron-shaped end tips of a pair of corner knife.

In the conventional type machine, when there is a need of changing the stitching measure of pipings the respective positions of said needles, working limit switches of center knife and stopper of corner knife after detaching the cover of the machine has to be moved by hand to the positions corresponding to the measure of the pipings on each occasion so that a considerable time is wasted for position adjustment by hand and, in addition, position errors are apt to occur resulting in the disagreement of the chevron-shaped end tips of corner knife with said ends of cloth cut (c) or the abundance of those defectively done resulting from puckers on the pipings. This necessitates carrying on a number of trial stitchings until the position adjustment has been affirmed good—thus the conventional machine has caused such inconveniences as stated above.

In order to avoid troubles in correctly adjusting the position, there is seen a tendency of adopting a system of one machine serving exclusively for stitching similar-sized pipings. This system however forces the need of preparing a good number of machines resulting in a remarkable lowering-down of the rate of operation of machines for stitching pocket sizes that need lesser amount of stitching.

The main object of the present invention is to offer a machine enabling the change of pocket sizes simply by the push of a switch existing on the machine.

Another object of the present invention is to offer a device to remarkably elevate the rate of machine operation along with the change of pocket sizes being carried out in a simple way.

The other objects and their characteristics of the present invention excepting those above described will further be clarified by the description to be given hereunder. In order to facilitate the present invention being readily understood, a description is made in details by the aid of accompanying drawings.

Figure 3:
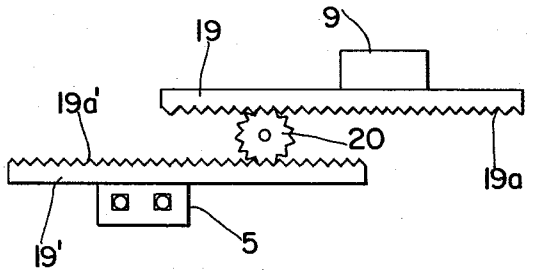
Figure 4:
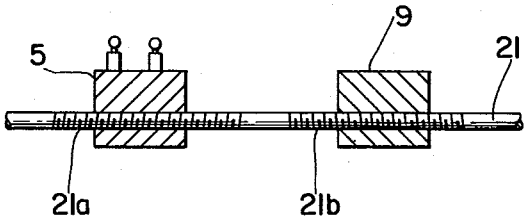
Figure 1:
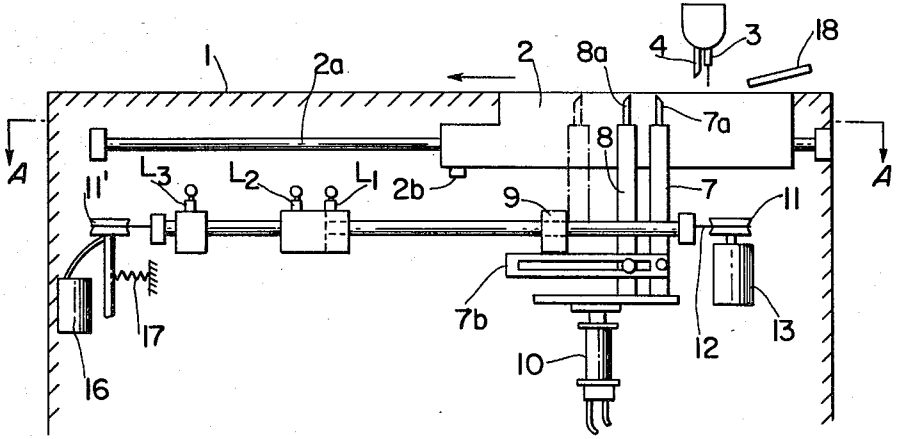
Figure 2:
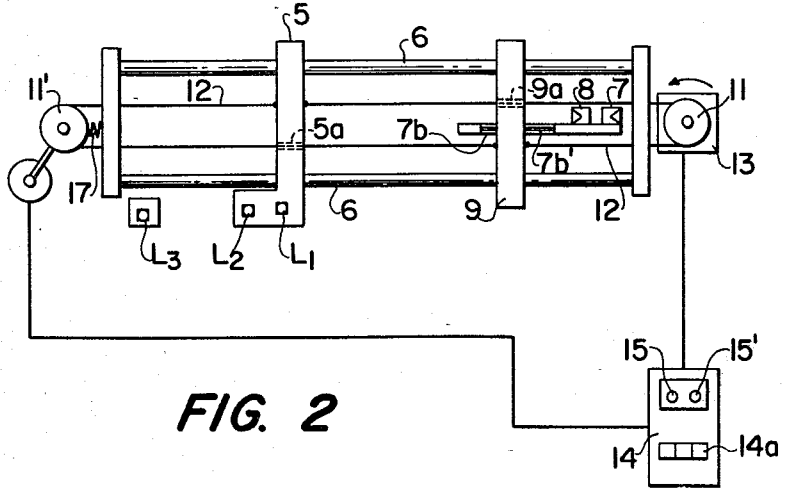

FIG. 1 illustrates a vertical section of the key portion of an automatic piping machine, FIG. 2 a sectional plan of line A—A, FIG. 3 a ground plane showing the driving means enabling to travel the working limit switch and the stopper that have been applied to racks and pinions, FIG. 4 a vertical section illustrating the driving means that has been made use of inverse screws, FIG. 5 a ground plane showing the cut of pocket and the structure of stitchings.

Below a description is made on the embodiment of the present invention with pertinent drawings therefor; as shown in FIG. 1 the frame (1) of an automatic piping machine is put in position a travelling plate (2) that moves forward or backward along the guide (2*a*) in the frame with suit materials on it.

The limit switch ($L_1$) that acts upon the needle (3) and the limit switch ($L_2$) that acts upon the center knife (4) are both affixed on the plate (5) and slide freely on the guide shaft (6) (6) jointly with said plate (5) and further on said shaft (6) (6) the stopper (9) of the driving corner knife base (8) that will be described later is fitted slidable facing said plate (5). (7) and (8) represent a pair of fixed and driving corner knife bases existing at the back of the frame (1) with each base being fitted with chevron-shaped knives (7*a*) (8*a*) respectively on the surface thereof. The driving corner knife base (8) positioning on the front travels freely front and back through the groove (7*b*') of the guide plate (7*b*) of the fixed corner knife base (7) positioning on the back end of the frame.

When said travelling plate (2) moves to the direction indicated by an arrow, a drag (2*b*) projecting from its lower surface hits the limit switch ($L_1$) that exists nearest to it to give motion to a couple of needles (3) (3) then hits the limit switch ($L_2$) to give motion to the center knife (4); further with the hitting of said drag (2*b*) of said travelling plate (2) upon the limit switch ($L_3$) affixed on the front end of frame (1) the function of said needles (3) (3) and center knife (4) that have been in motion earlier by means of limit switches ($L_1$) ($L_2$) is suspended and then the travelling plate (2) travels for a given length of distance to do feeding of suit materials.

On the other hand, said driving corner knife base (8) in line with the feeding of suit materials by said travelling plate (2) moves to the front through the groove (7*b*') of guide plate (7*b*) of said fixed corner knife base (7) until it hits the stopper (9) and by a cylinder (10) linking with said base said knives (7) (8) are pushed to the position of both ends of cut (c).

The aforesaid structure is practically as same as that of the conventional type machine of hand regulating type.

The present invention is characterized by such function as the plate (5) and the stopper (9) of machine having aforesaid structure have enabled to mechanically travel to opposite direction for an equal length of distance at the same time, for example, as shown in FIG. 2, a driving pulley (11) and idle pulley (11') are provided on both front and back ends between the guide shaft (6) (6) and are wound by wire (12) endlessly. Namely, the wire (12) passes through a hole (9*a*) of the stopper (9) and affixed on the plate (5) at one side while at the other side passes through a hole (5*a*) of the plate (5) and affixed on the stopper (9) respectively.

Said driving pulley (11) is connected to the motor (13) to run rightly or reversely by switch buttons (15) (15') on the operational panel (14) while the buttons are kept pushed on, for example, the switch button (15) makes the motor (13) run to the side of enlarging stitching sizes while the switch button (15') makes the motor (13) run to the side of shortening stitching sizes.

Further the idle pulley (11') is fitted with an angle detector (16) so that the angle of rotation is converted into the length which is indicated by digits in unit of millimeters on the aperture (14*a*) of said operational panel (14).

Further, in order to avoid idling of said idle pulley (11') fixed tensile force must constantly be given to the wire (12) by pushing said idle pulley (11') outward by means of spring (17) and the like when found necessary.

Mark (18) stands for a weight of suit materials.

The device travelling the plate (5) relatively whereupon said two limit switches ($L_1$) ($L_2$) mount and the stopper (9) of driving corner knife base (8) to opposite direction each other for an equal length of distance is not limited to that of wire type described above. For example, as shown in FIG. 3, the plate (5) and the stopper (9) are respectively fitted with racks (19) (19') facing gear tooth grooves (19*a*) (19'*a*) each other so that a pinion (20) that has been geared between the grooves (19*a*) (19'*a*) of said racks (19) (19') can run forward or reversely or as shown in FIG. 4, making the center portion as the line of demarcation on one side of a shaft rod (21) having screws (21*a*) (21*b*) that run counter each other the plate (5) lies while on the other exists the stopper (9) to run the shaft rod (21) forward or reversely. In either aforesaid travelling mechanism, the pinion (20) and the shaft rod (21) are fitted with an angle detector (16) respectively and the length of travel distance of the plate (5) and the stopper (9) can be detected similarly to aforesaid embodiment.

In the device of the present invention thus made up the plate (5) of limit switches ($L_1$) ($L_2$) and the stopper (9) of driving corner knife base (8) can travel to opposite direction each other for an equal length of distance.

Next will be decribed on the operational principle of the present invention with reference to the embodiment shown in FIG. 2. When there is a change in pocket sizes one of switch buttons (15) (15') is optionally kept on pushing until the digital value indicated on the operational panel (14) by means of the angle detector (16) of the idle pulley (11') reaches at a desired value, the plate (5) and the stopper (9) in line with the movement to either direction, forward or reversely, of the wire (12) travel for an equal length of distance to opposite direction each other on the guide shaft (6) (6) so that pocket sizes can optionally be enlarged or shortened.

The mechanism controlling the rotation of said motor (13) and detecting the travel distance of the plate (5) and the stopper (9) is not limited to the combination of said switch buttons (15) (15') and the digital counter; if the motor (13) is electrically suspended its motion at the point where the count amount of angle detector (16) and the set value of dial mounting on the operational panel (14) agree, the switch control of said motor (13) will be simplified.

Some fitting embodiments of the automatic piping machine of the present invention have been described above; any alteration excepting those aforementioned is also possible so long as it does not cross the spirit and scope of the patent claims to be particularized later on the present invention.

I claim:

1. A pocket forming apparatus having a center knife, two side needles and two corner cut knives, comprising:

a sewing plate having means for carrying a fabric material thereon, a drag fixed on said sewing plate such that the drag engages limit switches to start and stop said center knife and said two side needles, said two corner cut knives being essentially aligned with the line of travel of the center knife, and the distance between the corner cut knives being determined by the position of a stopper, and adjusting means for mechanically changing the distance between the limit switches for said starting and stopping simultaneously and equally with changing of the distance between said two corner cut knives.

2. The apparatus of claim 1, including a first travelling member having at least one of said limit switches thereon, the other limit switch being mounted independently of said first travelling member, a second travelling member including the said stopper, such that the location of the stopper, and hence the location of the second travelling member, determine the distance between the two corner cut knives, said adjusting means comprising interconnecting means for interconnecting the two travelling members, such that movement of one travelling member causes movement of the other travelling member.

3. The apparatus of claim 2, wherein the first travelling member includes the limit switch for starting the center cut knife, and the two corner cut knives include a forward knife and a rear knife, the rear corner cut knife being fixed longitudinally, and the forward corner cut knife being movable forwardly against the stopper, and said interconnecting means arranged to cause movement of one travelling member in a direction equal to and opposite from movement of the other travelling member.

4. The apparatus of claim 3, said interconnecting means including an endless wire connected to both of said travelling members such that movement of the first travelling member to reduce the distance between the two limit switches causes the second travelling member, and hence the stopper, to move an equal opposite distance to reduce the distance between the two corner cut knives.

5. An apparatus according to claim 4, said endless wire mounted on a pair of pulleys with two opposed strands running between the pulleys, the first travelling member connected to one of said strands, and the second travelling member connected to the other of said strands, and a motor means for turning one of the pulleys to move the travelling members.

6. The apparatus of claim 5, including sensing means for sensing rotation of one of the pulleys, and hence also of sensing movement of the travelling members, and including a control means interconnecting said sensing means and said motor means for controlling travel of the travelling members.

7. The apparatus according to claim 3, said interconnecting means comprising a rack connected to each travelling member, and a pinion gear meshing with both of said racks.

8. The apparatus according to claim 3, said interconnecting means comprising a screw having opposed oppositely threaded portions, each of said portions connected to one of said travelling members.

9. The apparatus according to claim 2, including motor means for causing relative movement of the two travelling members, sensing means for sensing the movement of said travelling members, and a control means interconnecting said motor means and said sensing means for controlling relative movement of the travelling members.

10. The apparatus according to claim 9, wherein the motor means stops movement of the travelling members after movement of the travelling members has been completed by a predetermined amount.

* * * * *